US006776724B1

(12) United States Patent
Siemsglusz

(10) Patent No.: US 6,776,724 B1
(45) Date of Patent: Aug. 17, 2004

(54) GOLF PUTTER

(76) Inventor: Michael C. Siemsglusz, 3400 Mach #1 Dr., Norfolk, NE (US) 68701

( * ) Notice: Subject to any disclaimer, the term of this patent is extended or adjusted under 35 U.S.C. 154(b) by 0 days.

(21) Appl. No.: 10/372,376

(22) Filed: Feb. 22, 2003

(51) Int. Cl.[7] ..... A63B 53/16
(52) U.S. Cl. ..... 473/294; 473/296; 473/299
(58) Field of Search ..... 473/294, 239, 473/298, 299, 296; 403/109.4, 109.5

(56) References Cited

U.S. PATENT DOCUMENTS

| | | | | |
|---|---|---|---|---|
| 2,475,927 | A | 7/1949 | Verderber | 273/80 |
| 2,879,065 | A | 3/1959 | Smith | 273/81.2 |
| 3,539,185 | A | 11/1970 | Andis | 273/81.2 |
| 4,674,747 | A | 6/1987 | Mazzocco et al. | 273/81.2 |
| 5,029,860 | A | 7/1991 | Ehrich | 273/81.2 |
| 5,356,235 | A | 10/1994 | Brown et al. | 403/350 |
| D363,519 | S | 10/1995 | Gooden | D21/221 |
| D364,436 | S | 11/1995 | Thomas | D21/221 |
| D370,953 | S | 6/1996 | Visalli | D21/221 |
| 5,792,006 | A | 8/1998 | Hesser | 473/239 |
| 5,997,412 | A | 12/1999 | Benson | 473/296 |
| 6,447,404 | B1 | 9/2002 | Wilbur | 473/296 |
| 2002/0111227 | A1 * | 8/2002 | Wilson | 473/316 |

FOREIGN PATENT DOCUMENTS

| | | |
|---|---|---|
| WO | WO 88/07880 | 10/1988 |

* cited by examiner

*Primary Examiner*—Stephen Blau
(74) *Attorney, Agent, or Firm*—Thomte, Mazour & Niebergall; Dennis L. Thomte

(57) ABSTRACT

A golf putter is described which may be used as a regular length putter, a mid-length putter and a long putter. A conventional regular length putter has as assembly detachably secured thereto which enables the putter to be used as a mid-length putter and as a long putter as desired.

7 Claims, 5 Drawing Sheets

GOLF PUTTER

BACKGROUND OF THE INVENTION

1. Field of the Invention

This invention relates to a golf putter and more particularly to a golf putter which may be selectively used as a regular length putter, a mid-length putter and a long putter.

2. Description of the Related Art

Historically, regular length putters normally have a standard length of between 33" and 36". In an effort to increase their putting skills and to reduce the effects of the "yips", golfers have switched from the regular length putters to mid-length putters and long putters. The mid-length putters are also known as "belly" putters and have a length of approximately 38" to 45" while a long putter has a length of approximately 46" to 52". If a golfer purchases a regular length putter, it obviously cannot be used as a mid-length putter or a long putter. Further, if a golfer purchases a mid-length putter, the putter cannot be used as a regular length putter or a long putter. Additionally, if a golfer purchases a long putter, it cannot be used as a mid-length putter or a regular length putter. Also, the mid-length putters and long putters, once purchased, can only have their lengths shortened by cutting the shafts and/or grips thereof. Further, the long putters do not normally fit within conventional golf club travel bags and therefore must be shipped or checked separately.

SUMMARY OF THE INVENTION

A golf putter is disclosed which may be used as a regular length putter, a mid-length putter and a long putter. The putter of this invention comprises a first elongated, hollow shaft having upper and lower ends; a putter head secured to the lower end of the first shaft; a first grip, having upper and lower ends, mounted on the first shaft at the upper end thereof. The first grip, first shaft and putter head may be used as a regular length putter. The open upper end of the first shaft is exposed at the upper end of the first grip. A second elongated, hollow shaft having upper and lower ends is also provided which has a second grip, having upper and lower ends, mounted on the upper end of the second shaft. A stabilizer tube assembly forms a part of the invention which comprises a hollow tube having upper and lower ends, an enlarged portion between the upper and lower ends of the hollow tube, and a locking screw which selectively threadably extends inwardly through the enlarged portion into the interior of the tube. An elongated externally threaded rod having upper and lower ends extends downwardly through the second grip and the second shaft so that the lower end of the threaded rod is positioned below the lower end of the second shaft. A selectively expandable locking mechanism is mounted on the lower end of the threaded rod which is movable with the rod between expanded and contracted positions. The lower end of the hollow tube of stabilizer tube assembly is selectively receivable downwardly into the exposed upper end of the first shaft until the enlarged portion engages the upper end of the first grip. The lower end of the second shaft and the expandable mechanism are selectively receivable downwardly through the hollow tube until the second grip engages the upper end of the hollow tube. The locking screw is in selective locking engagement with the second shaft to maintain the second shaft in various positions relative to the hollow tube. The expandable locking mechanism, when in its expanded position, engages the interior wall surface of the first shaft to prevent relative movement of the second shaft with respect to the first shaft. The first grip, first shaft, putter head, stabilizer tube assembly, second shaft and second grip function as a mid-length putter when the second shaft is positioned within the first shaft and the second grip is positioned near the upper end of the hollow tube. The first grip, first shaft, putter head, stabilizer tube, second shaft and second grip functions as a long putter when the second grip is positioned sufficiently upwardly of the stabilizer tube assembly. The expandable locking mechanism selectively maintains the second shaft in a fixed position relative to the first shaft when the components are positioned in the mid-length putter and long putter modes.

It is therefore a principal object of the invention to provide an improved putter.

A further object of the invention is to provide a golf putter which may be used as a regular length putter, a mid-length putter and a long putter.

Yet another object of the invention is to provide a long putter which may be disassembled for travel.

Yet another object of the invention is to provide a putter of the type described which is easily disassembled and reassembled into its former mid-length putter or long putter length modes.

Yet another object of the invention is to provide a putter of the type described which complies with USGA rules.

These and other objects will be apparent to those skilled in the art.

DESCRIPTION OF THE PREFERRED EMBODIMENT

Figure 1:
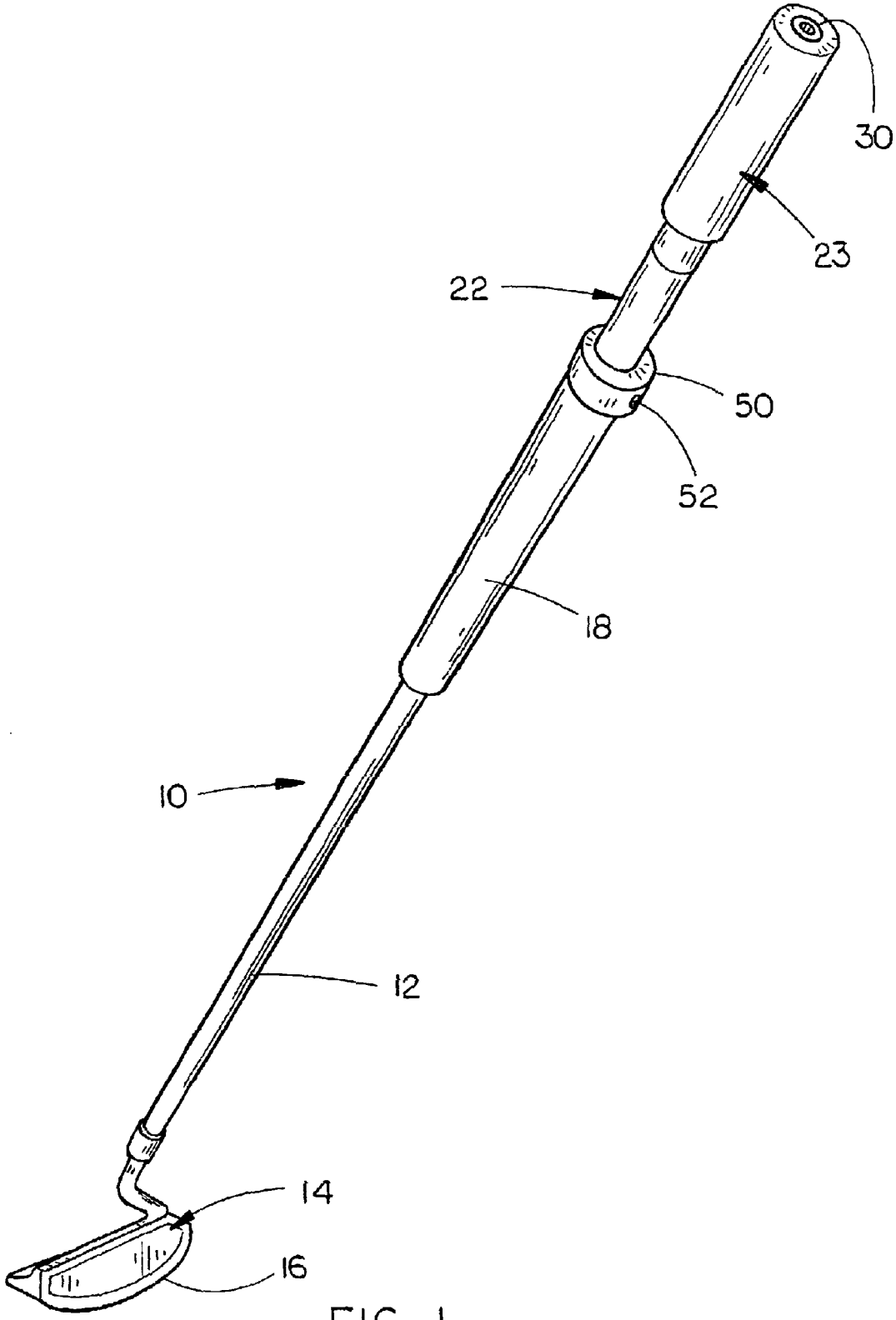
FIG. 1 is a perspective view of the putter of this invention when in its mid-length mode.

The numeral 10 refers to a generally conventional regular length putter including a hollow shaft 12 preferably comprised of a metal material such as steel, but which may be comprised of aluminum, graphite, carbon, etc. A head 14 preferably including a rocker sole 16 is mounted on the lower end of shaft 12 in conventional fashion. Grip 18 is mounted on the upper end of shaft 12 in conventional fashion. The only difference between putter 10 and a conventional regular length putter is that in conventional putters, the upper or butt end of shaft 12 will be enclosed within the grip 18 by the upper end of the grip 18 while in putter 10, the open upper end 20 of the shaft 12 is exposed. If desired, the putter 10 may be used as a conventional regular length putter which would normally have a standard length of between 33 and 36 inches.

The numeral 22 refers to the auxiliary or "add-on" assembly of this invention which enables the putter 10 to be used as a "mid-length" (belly) putter having a length of approximately 38 to 45 inches or a "long" putter having a length of approximately 46 to 52 inches. Assembly 22 includes a grip 23 having an upper end 24 and a lower end 25. Grip 23 preferably has the same exterior configuration as the grip 18 which in this case is round. It is believed that United States Golf Association (USGA) regulations require the grips on split grip putters to have the same exterior configuration.

Figure 8:
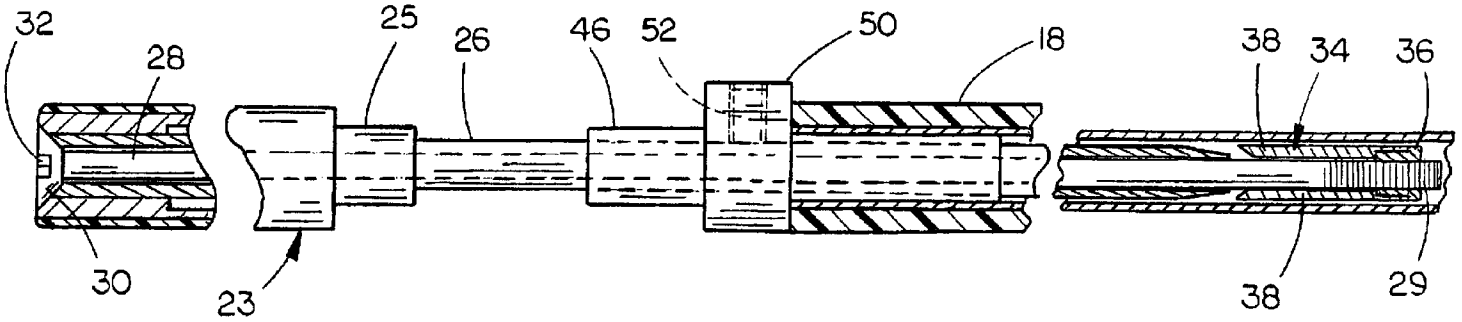
FIG. 8 is a sectional view illustrating the expandable locking mechanism in its unlocked position.
Figure 9:
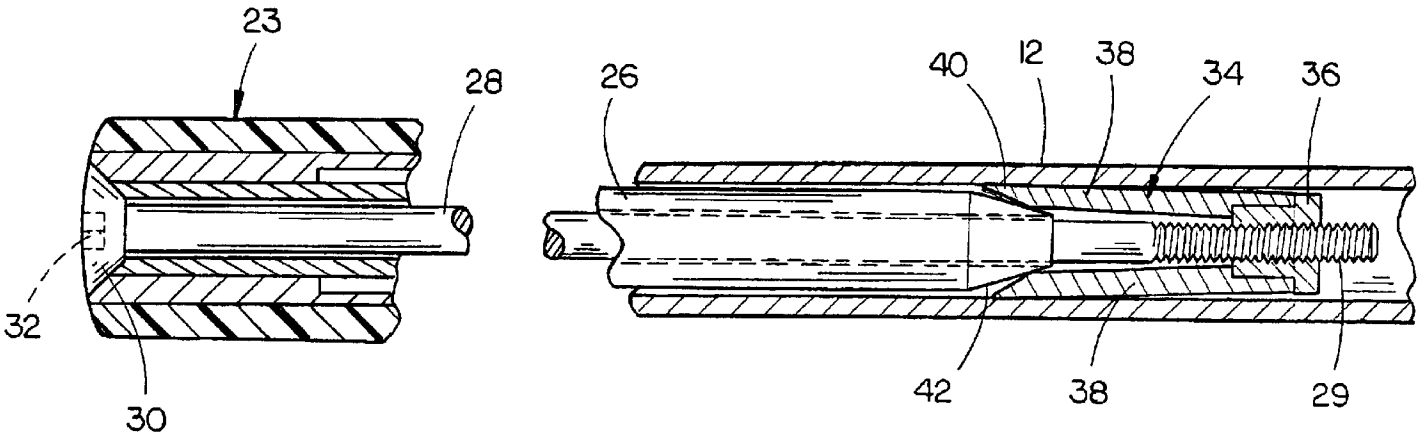
FIG. 9 is a sectional view illustrating the expandable locking mechanism in its locked position.

Shaft 26 has its upper end portion mounted in grip 23 and extends downwardly therefrom. An elongated rod or bolt 28 is rotatably mounted in shaft 26, as seen in the drawings, and has an externally threaded lower end portion 29. The upper end of rod 28 has a head portion 30 normally countersunk into the upper end of grip 18 and which has a socket 32 formed therein adapted to receive an Allen wrench or the like. An expandable locking mechanism 34 or similar device is provided on the lower end of rod 28, as seen in the drawings. The locking mechanism 34 may take many shapes and forms. One type of locking mechanism 34 is shown in the drawings. In the embodiment shown in the drawings, locking mechanism 34 has its lower end 36 threadably mounted on threaded portion 29 of rod 28 which extends downwardly from the lower end of shaft 26. Locking mechanism 34 includes a plurality of expansion arms 38 extending upwardly from lower end 36. In the inoperative or unlocked position, the arms 38 dwell closely adjacent rod 28 (FIG. 8). When rod 28 is rotatably moved with respect to shaft 26 with the locking mechanism being held against rotation due to a slight (at this time) frictional engagement with the interior surface of shaft 12, the locking mechanism 34 moves upwardly with respect to shaft 26 so that the upper ends 40 of arms 38 engage the nose portion 42 secured to the lower end of shaft 26 thereby causing the arms 38 to expand or move outwardly away from rod 28 to firmly engage the inside surface of shaft 12 as will be described in more detail hereinafter. Rotation of rod 28 in the opposite direction to the just described causes the rod 28 to move upwardly with respect to locking mechanism 34 so that arms 38 disengage from nose 42 to release arms 38 from gripping engagement with the inside surface of shaft 12 as will also be described in greater detail hereinafter.

Assembly 22 also preferably includes a stabilizer tube 44 having an upper tube portion 46 and a lower tube portion 48. Formed with tube portions 46 and 48 is a cylindrical head 50 having a set screw 52 threadably extending therethrough into the interior of tube 44. Although the putter of this invention, when in its mid-length mode or its long length, will function without stabilizer tube 44, it is preferred that tube 44 be used since it prevents undesirable movement between the shaft 26 and the upper end of the shaft 12. The stabilizer tube 44 also serves as a memory to return the putter to its exact preferred long length as will be described hereinafter.

As previously stated, the putter 10 is a conventional regular length putter with the only difference between putter 10 and the conventional regular length putter is that the upper end of the grip 18 has been cut away to expose the open upper end 20 of the shaft 12. It is also preferred that the putter 10 have a rocker sole 16 since the shaft 12 will reside in different angles when the putter is being used as a regular length putter, mid-length putter and long putter. Accordingly, the putter 10 may be used by the golfer in conventional fashion.

Figure 2:
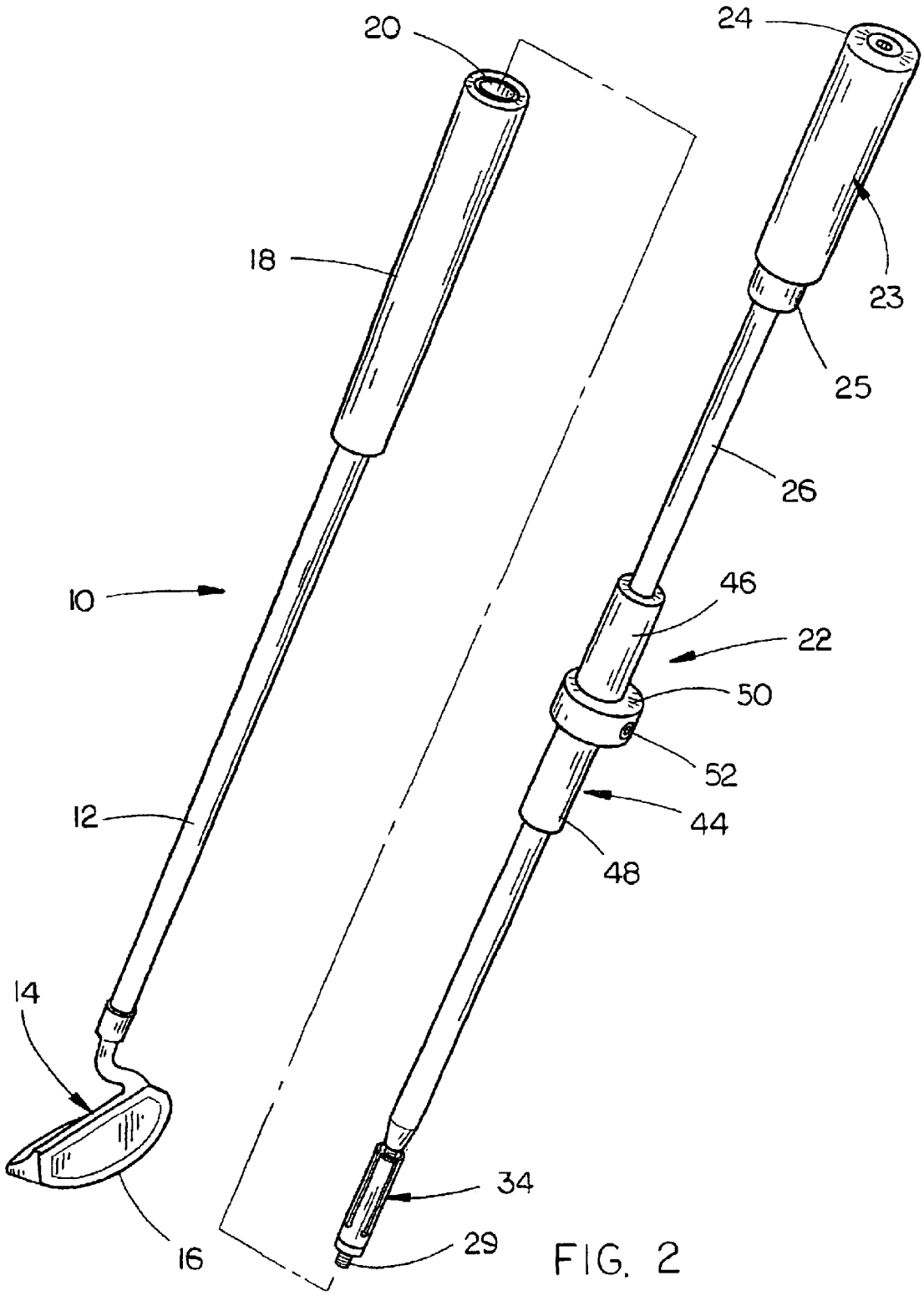
FIG. 2 is an exploded perspective view of the putter of this invention.
Figure 6:
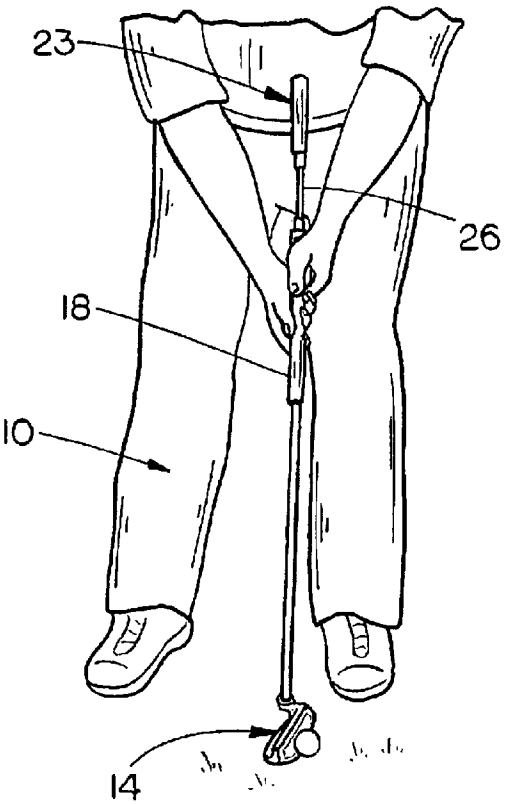
FIG. 6 is a view illustrating the putter being used in its mid-length or belly putter mode.
Figure 5:
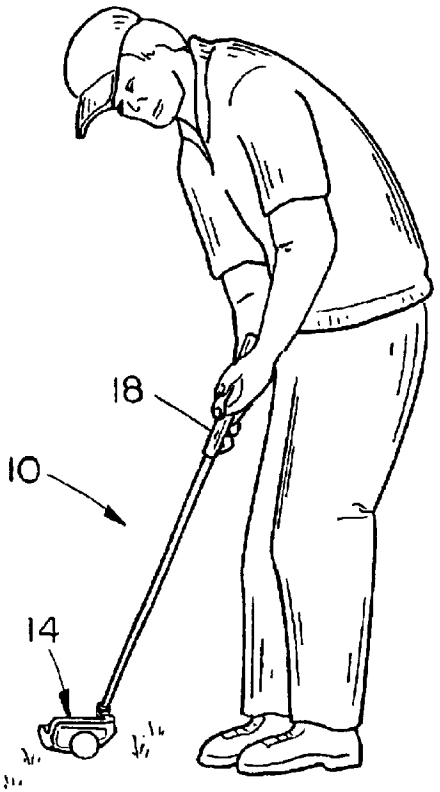
FIG. 5 is a view illustrating the putter being used in its regular length mode.

The add-on assembly 22 illustrated at the right side of FIG. 2 is provided to enable the putter 10 to be converted to a mid-length putter or to a long putter. Assuming that the putter is going to be used in the mid-length mode, shaft 26 is extended downwardly through stabilizer tube 22 until the lower end of the grip 23 engages the upper end of the tube 46. At that time, the set screw 52 is threadably moved inwardly through head 50 so that the inner end of the set screw 52 engages the exterior surface of the shaft 26. When the expandable locking mechanism 34 is in its unlocked position, the locking mechanism 34 and the lower end of shaft 26 are inserted downwardly through the open upper end 20 of the shaft 12 until the head 50 of stabilizer tube assembly 22 engages the upper end of the grip 18. At that time, the rod 28 is rotated to cause the arms 38 of the locking mechanism 34 to be moved outwardly into locking engagement with the interior surface of the shaft 12 which locks the shaft 26 in position with respect to shaft 12. When the components have been assembled as just described, a mid-length putter will be provided, such as illustrated in FIGS. 1 and 6. The length of the mid-length putter of FIG. 1 may be varied according to the needs of a particular golfer by disengaging the locking mechanism 34 and loosening the set screw 52 The shaft 26 may then be slidably moved upwardly with respect to stabilizer tube assembly 22 until the proper mid-length position is achieved. At that time, the locking mechanism 34 is again engaged and the set screw 52 is engaged.

Figure 3:
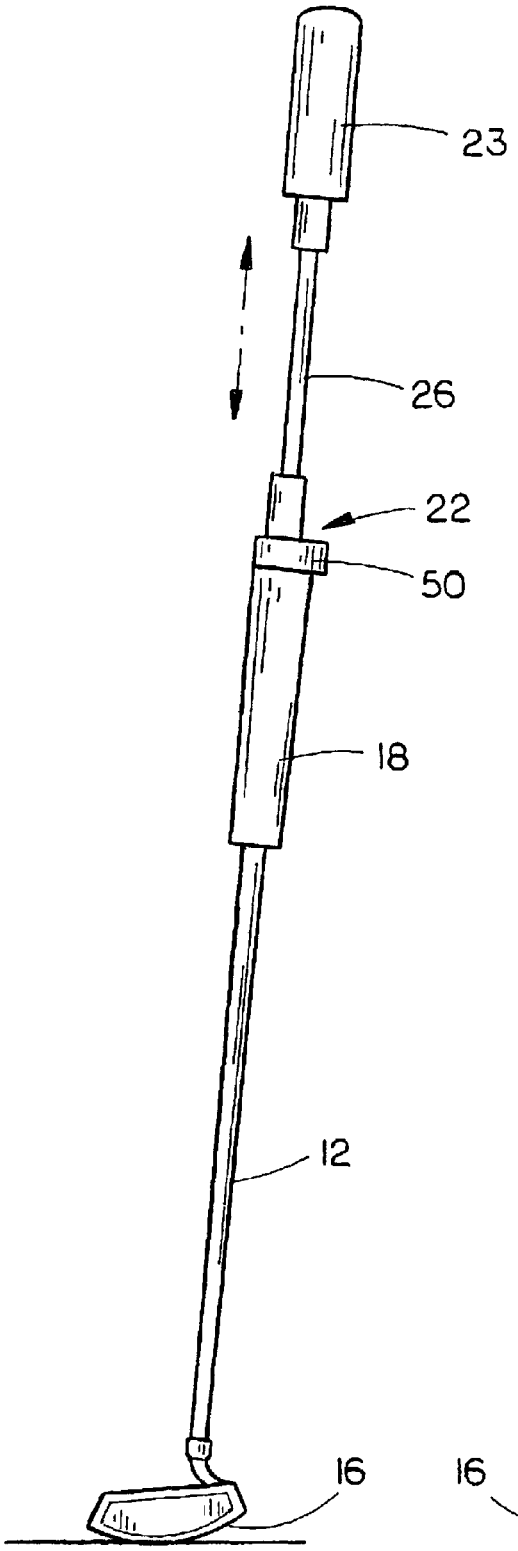
FIG. 3 is a side view of the putter in its long putter mode.
Figure 4:
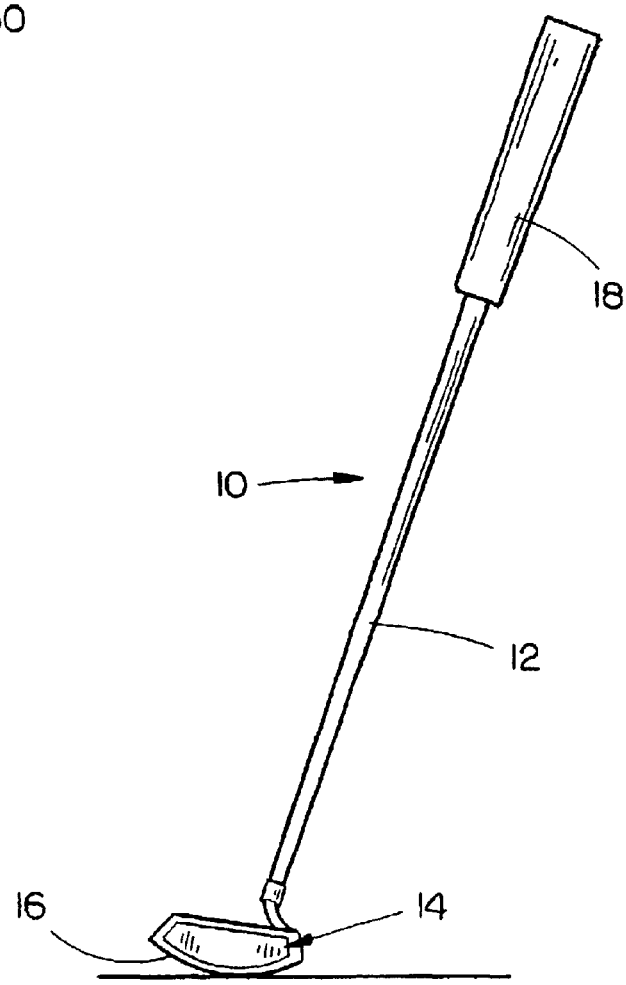
FIG. 4 is a side view of the putter in its regular length mode.
Figure 7:
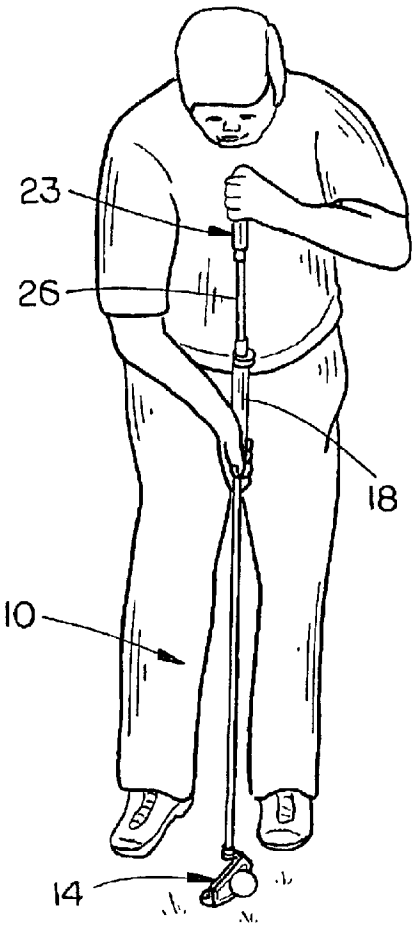
FIG. 7 is a view illustrating the putter being used in its long putter mode.

The steps just described in adjusting the length of the mid-length putter are also utilized to position the shaft 26 so that a long putter, such as illustrated in FIGS. 3 and 7, is provided. Ordinarily, the putter, when in its long mode, will be too long to fit in a conventional golf travel bag. The length of the long putter is easily reduced for travel purposes by simply disengaging the locking mechanism 34 from engagement with the interior surface of shaft 12. The grip 23, shaft 26 and stabilizer tube assembly 22 are then removed from the putter 10. Normally, the set screw 52 will remain in engagement with the shaft 26 when the assembly 22 is removed from the putter 10 so that the previously adjusted length of the long putter will be duplicated when the putter is assembled after travel. Thus, upon arriving at the travel location, shaft 26 is simply inserted downwardly through the open upper end of the grip 18 until the head portion 50 engages the upper end of the grip 18. The locking mechanism 34 will then be engaged and the putter will have the same length as when it was disassembled for travel.

Thus it can be seen that a novel putter has been described which may be used as a regular length putter, a mid-length putter or a long putter. It can therefore be seen that the invention accomplishes at least all of its stated objectives.

I claim:

1. A golf putter which is usable as a regular length putter, a mid-length putter and a long puffer, comprising:

a first elongated, hollow shaft having upper and lower ends;

a putter head secured to the lower end of said first shaft;

a first grip, having upper and lower ends, mounted on said first shaft at the upper end thereof;

said upper end of said first shaft being exposed at the upper end of said first grip;

a second elongated shaft having upper and lower ends;

a second grip, having upper and lower ends, mounted on said upper end of said second shaft;

a stabilizer tube assembly comprising a hollow tube having upper and lower ends, an enlarged portion between said upper and lower ends of said hollow tube, and a locking screw selectively threadably extending inwardly through said enlarged portion into the interior of said hollow tube;

an elongated rod having upper and lower ends;

said rod rotatably extending downwardly through said second grip and said second shaft;

said rod having its lower end positioned below the lower end of said second shaft;

a locking mechanism associated with said lower end of said rod which is movable with respect to said rod between locked and unlocked positions;

said first grip, first shaft and putter head functioning as a regular length putter;

said lower end of said hollow tube of said stabilizer assembly being selectively receivable downwardly into the exposed upper end of said first shaft until said enlarged portion engages said upper end of said first grip;

said lower end of said second shaft and said locking mechanism being selectively receivable downwardly through said hollow tube;

said locking screw being in selective locking engagement with said second shaft to maintain said second shaft in various positions relative to said hollow tube;

said locking mechanism, when in its said locked position, engaging the interior wall surface of said first shaft to prevent relative movement of said second shaft with respect to said first shaft;

said first grip, first shaft, putter head, stabilizer tube, second shaft and second grip functioning as a mid-length putter when said second shaft is positioned within said first shaft and said second grip is positioned near said upper end of said hollow tube and functioning as a long putter when said second grip is positioned sufficiently upwardly of said stabilizer tube assembly;

said locking mechanism selectively maintaining said second shaft in a fixed position relative to said first shaft when the said components are positioned in the mid-length putter and long putter modes.

2. The golf putter of claim 1 wherein said upper end of said rod has a head portion adapted to receive one of an Allen wrench or screw driver.

3. The golf putter of claim 1 wherein said second tube and said stabilizer tube assembly is removable from said first shaft when said locking mechanism is in its said unlocked position.

4. The golf putter of claim 3 wherein said stabilizer tube assembly remains in its fixed position relative to said second shaft when said second shaft is removed from said first shaft unless said locking screw is threadably loosened.

5. The golf putter of claim 1 wherein said locking mechanism comprises an expandable mechanism.

6. The golf putter of claim 1 wherein said lower end of said rod has a threaded portion thereon and wherein said locking mechanism comprises a support threadably mounted on said threaded portion of said rod, said support having an expandable means associated therewith which is selectively movable into functional engagement with the interior surface of said first shaft.

7. The golf putter of claim 6 wherein said expandable means comprises a plurality of spaced-apart arms secured to said support which extend upwardly therefrom, said arms being selectively movable between expanded and contracted positions.

* * * * *